US006941613B2

(12) United States Patent
Bryant

(10) Patent No.: US 6,941,613 B2
(45) Date of Patent: Sep. 13, 2005

(54) PIPE CLEANING VACUUM SEALING APPARATUS

(75) Inventor: David D. Bryant, Bellville, OH (US)

(73) Assignee: Trap Vac, LLC, Bellville, OH (US)

( * ) Notice: Subject to any disclaimer, the term of this patent is extended or adjusted under 35 U.S.C. 154(b) by 343 days.

(21) Appl. No.: 10/163,281

(22) Filed: Jun. 5, 2002

(65) Prior Publication Data

US 2003/0226229 A1 Dec. 11, 2003

(51) Int. Cl.[7] ..... A47L 7/00
(52) U.S. Cl. ..... 15/304; 15/406; 4/255.01
(58) Field of Search ..... 15/304, 406; 4/255.01, 4/255.04, 255.05, 255.08; 277/602, 606–609, 612, 615, 618; 285/226, 302–303, 134.1

(56) References Cited

U.S. PATENT DOCUMENTS 2,736,906 A * 3/1956 Ramseur ..... 4/255.04
3,023,428 A * 3/1962 Otteson ..... 4/255.04
3,077,638 A 2/1963 Hickam
3,599,820 A 8/1971 Lee
3,927,866 A 12/1975 Linquist
4,059,858 A * 11/1977 Lambel et al. ..... 15/406
4,317,247 A 3/1982 Levine
4,902,023 A 2/1990 Opresko
5,193,245 A * 3/1993 Brzoska ..... 15/406
5,522,672 A 6/1996 Moore
5,700,014 A 12/1997 Morita
5,946,767 A 9/1999 Sinz
6,013,138 A 1/2000 Sinz
6,263,535 B1 7/2001 Wang
6,345,410 B1 * 2/2002 Baker ..... 15/406

* cited by examiner

*Primary Examiner*—Theresa T. Snider
(74) *Attorney, Agent, or Firm*—Gallagher & Dewey Co. LPA; Daniel J. Dewey; Michael J. Gallagher

(57) ABSTRACT

A pipe cleaning vacuum sealing apparatus includes an intra piping sealing frustum. The frustum is generally shaped as a frustum of a circular cone with an interior and exterior surface. The interior surface is adapted to releasably receive a plurality of various vacuum suction sources. The exterior surface of the frustum is adapted to be releasably received by a plurality of configurations of pipe openings.

Alternatively, the pipe cleaning vacuum sealing apparatus includes an extra piping system sealing boot. The sealing boot releasably seals at the surface surrounding a pipe and is adapted to releasably receive a plurality of various vacuum suction sources.

Embodiments of the pipe cleaning vacuum sealing apparatuses include a plurality of annular engaging rings to enhance sealing, fixed and telescoping suction tubes, and varying embodiments of separation and retainage chambers further including separation and retainage chambers with at least one ingress port.

15 Claims, 6 Drawing Sheets

PIPE CLEANING VACUUM SEALING APPARATUS

TECHNICAL FIELD

The invention relates to the field of pipe cleaning tools, and specifically, to a pipe cleaning vacuum sealing apparatus that makes it possible to achieve a positive vacuum seal between a vacuum source and a piping system in order to clear obstructions in a pipe by negative pressure application.

BACKGROUND OF THE INVENTION

The need for cleaning pipes, particularly gravity drainage piping, is a recurring problem for technicians in the field. A method of pipe cleaning must entail a method of either removing an obstruction in a retrograde fashion to the pipe inlet or cleaning port, or else pushing the obstruction anterograde such that it can be carried away by flow within the pipe. The obstruction removal is obviously best conducted with a technique designed to minimize the danger of damage to the pipe itself. What has been needed but was heretofore unavailable is an apparatus to facilitate the cleaning of piping with commonly available vacuum sources such as high-vacuum industrial truck units as well as relatively low-vacuum shop vacuum devices.

In the past various methods have been employed to remove obstructions from piping systems. Perhaps the most traditional has been the use of a plumber's rod, often denominated a "snake," as demonstrated in U.S. Pat. No. 4,317,247 to Levine. Such a tool features an enlarged end to the rod, which serves to manually engage the obstruction. Rotary force applied to the rod tends to either snag the obstruction for retrograde removal, or to manually break it up for anterograde flushing. Due to such method of operation, the tool is best utilized on obstructions that are either soft enough to be snagged by the tool, or friable enough to be broken up for flushing. Once friable obstructions are broken up they often simply accumulate at the next change of direction in the piping system and re-clog the piping. Obstructions formed by multiple discrete objects are less vulnerable to this approach, as the rod will tend to separate the obstructions without removing them, particularly when those multiple objects are hard in nature and cannot be snagged by the rod for retrograde removal. In such a situation, obstructions will be churned, but are likely neither to be removed retrograde nor pushed through the pipe. Multiple small obstructions, by way of example and not limitation, such as multiple small pieces of metal, can be particularly problematic in pipes transmitting high viscosity fluids, where the obstruction to flow posed by such objects is the greatest. This is particularly problematic in automotive repair garages and the drains of similar industrial locations.

An alternative approach to pipe obstruction removal is demonstrated by U.S. Pat. No. 6,013,138 to Sinz. In the Sinz '138 device, a length of tubing is passed through the lumen of the pipe, proximal to the obstruction, and a stream of water is directed from the end of the tubing to apply mechanical force to break up an obstruction. A vacuum apparatus is applied at the top of the pipe to remove both the flushing water and the broken up pieces of the obstruction. This removal method has the disadvantage of requiring the vacuum removal of water or some other relatively high-density solvent used to mobilize the obstruction, and any air, which is very low in relative density, which is entrained proximal to the obstruction will severely hamper vacuum effectiveness. Any leak in the vacuum seal will tend to preferentially entrain air over solvent, and will preferentially entrain air in regard to removal of debris. This effect is exacerbated as the relative density difference between atmospheric air and the density of the debris increases, i.e., the more dense the obstructions, or the multiple objects making up an obstruction, the more preferentially will air be entrained.

Vacuum systems, such as that described by Sinz '138, have failed to provide positive methods for avoiding this entrainment of air. The problem is made more difficult by the fact that pipe entrances may be encountered in a plurality of sizes; shapes; and design possibilities, such as the various sizes and shapes of floor drains and cleanouts for gravity drainage systems as well as the various sizes and pipe joining methods for process, hydronic, domestic water, fire protection and the multitude of other piping systems.

Accordingly, the art has needed a means for providing a positive vacuum seal at a plurality of pipe sizes and configurations, without rigid adaptors and without damaging the inlet of the piping system, while facilitating its use with commonly available vacuum sources. Therefore, what continues to be needed but is missing from the field of pipe cleaning tools is an apparatus for creating a positive vacuum seal between a vacuum source and a piping system that is designed for ease of use and manufacture. While some of the prior art devices attempted to improve the state of the art of pipe cleaning tools, none has achieved a cost optimized capability that is easy to fabricate and convenient to use with a wide variety of vacuum sources and piping systems. With these capabilities taken into consideration, the instant invention addresses many of the shortcomings of the prior art and offers significant benefits heretofore unavailable.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations.

In one of the many preferable configurations, the pipe cleaning vacuum sealing apparatus incorporates, among other elements, an intra piping system sealing frustum. The sealing frustum is generally shaped as a frustum of a circular cone. The sealing frustum has an exterior surface and an interior surface with the interior and exterior surfaces being generally parallel. Alternatively, the exterior surface may be oriented at a greater angle from the vertical than the interior surface, such that the sealing frustum exhibits a greater thickness between the interior and exterior surface at the more distal aspect of the sealing frustum. The exterior surface is releasably received by the piping system. Release from, and sealing to, the piping system is facilitated by fabricating the exterior surface of the frustum of a resilient material, such as, for the purpose of illustration and not limitation, any of those in the general categories of elastomers and plastics. Alternatively, the entire frustum may be fabricated of such resilient material. The interior surface releasably and slideably receives the vacuum source. Typically, the exterior surface is compressed against either the drain body or the pipe inlet thus forming a substantially airtight seal. Similarly, the vacuum source often terminates with a suction wand, often a 2" diameter section of pipe approximately 24"–48" in length, that is forced through the center of the sealing frustum forming a substantially airtight seal between the interior surface and the suction wand. The suction wand may then be forced into the piping system and retracted from the piping system while maintaining the substantially airtight interface between the sealing frustum and the drain body or pipe inlet, as well as the interface between the vacuum source and the interior surface.

The sealing frustum's shape being generally similar to that of a frustum of a circular cone allows great flexibility in maintaining substantially airtight seals with the wide variety of drain bodies, pipe inlets, and vacuum sources. For large drain bodies and pipe inlets the sealing frustum may be forced deeply into the body or inlet to obtain the desired seal, whereas for smaller openings the sealing frustum may need only rest in the body or inlet to obtain a substantially airtight seal. Similarly, since the interior surface is generally parallel to the exterior surface, or, alternatively, formed with the exterior surface oriented at a lesser angle from the vertical than the interior surface, such that the sealing frustum exhibits a greater thickness between the interior and exterior surface at he more distal aspects of the sealing frustum, it may be used with a wide variety of vacuum sources and sizes. For example, by way of illustration and not limitation, resilient construction of a single pipe cleaning vacuum sealing apparatus may easily accommodate pipe inlet diameters, or drain body diameters, of varying sizes. Similarly, a single pipe cleaning vacuum sealing apparatus may easily accommodate vacuum sources ranging in varying diameters. Additionally, multiple variations and sizes of pipe cleaning vacuum sealing apparatus of similar configurations to those described herein will be obvious to one skilled in the art for use with piping systems of smaller diameters such as domestic water systems, as well as piping systems of larger diameters, such as storm sewer systems and cooling tower piping systems. Further, while the preceding examples refer to round drain bodies, pipe inlets, and vacuum sources, the pipe cleaning vacuum sealing apparatus may be configured to accommodate all non-circular shapes.

Numerous embodiments incorporate various annular engaging rings, both in the exterior surface and the interior surface. For instance, the exterior surface of the sealing frustum may include any number of annular piping system engaging rings. Such piping system engaging rings are compressed as the exterior surface is compressed against the drain body or the pipe inlet, thus improving the seal between the surfaces and accommodating irregularities in the surfaces. Similarly, vacuum source engaging rings may be formed on the interior surface to improve the seal between the interior surface and the vacuum source. The piping system engaging rings and the vacuum source engaging rings may be formed in any number of cross-sectional geometries. For example, the piping system engaging rings and the vacuum source engaging rings may be formed with generally semi-circular cross-sections or generally rectangular cross-sections. Additionally, the exterior surface of the sealing frustum may include indicia to indicate the appropriate depth of insertion into pipe inlets based upon the diameter of the pipe inlet and the amount of vacuum applied.

Additional embodiments of the present invention may include a stationary suction tube having a vacuum hose coupling at the distal end and a suction tube sealer at the proximal end. The suction tube sealer is similar to the sealing frustum of the previous embodiment except that in this embodiment it is attached to a stationary suction tube rather than facilitating an external vacuum source device such as a suction wand to pass through it. The suction tube sealer has both an inner surface and an outer surface. The outer surface is adapted to be releasably received by the piping system and may include at least one piping system engaging ring as previously described.

The vacuum hose coupling is adapted to releasably receive the vacuum source. The vacuum hose coupling may include any one of the many available coupling devices such as, for example but not limitation, boss couplers, universal couplers, cam lock shank couplers, combination nipple couplers, and cam and groove quick couplers. Additionally, the coupler may include any number of hose fittings that reduce the likelihood of crimping the vacuum hose. For example, the coupler may include a forty-five degree long sweep elbow type fitting so that the vacuum hose would not need to be bent into a sharp ninety degree turn to fluidly join the generally orthogonal stationary suction tube. Further, the coupler may include a shut-off valve to turn on and turn off the vacuum as well as throttle the amount of vacuum. The stationary suction tube of the present embodiment has an interior surface, an exterior surface, a stationary suction tube proximal end, and a stationary suction tube distal end.

A further variation includes a telescoping suction tube having an interior surface and an exterior surface. The telescoping suction tube is slideably received within the stationary suction tube. When the exterior surface of the telescoping suction tube and the interior surface of the stationary suction tube are similar in size, a slideable friction fit between the stationary suction tube interior surface and the telescoping suction tube exterior surface is created. The present embodiment allows the user to extend the telescoping suction tube into the piping system.

Additionally, the present embodiment may include a telescopic retainer adapted to releasably secure the telescoping suction tube to the stationary suction tube. This allows the telescoping suction tube to be secured in the extended position or the non-extended position. Any number of commonly available retainers may be used for the telescopic retainer and they additionally define a telescoping suction tube range of motion.

Any of the preceding embodiments may include a separation and retainage chamber. The separation and retainage chamber is generally connected to the vacuum hose coupling at a chamber distal end and fluidly connected to the stationary suction tube at a chamber proximal end. The purpose of the separation and retainage chamber is to capture and retain objects that are removed from the piping system. The chamber protects the vacuum source from damage that may be caused by objects leaving the piping system and entering the vacuum source. The chamber may include an impediment impingement device to deflect objects toward the perimeter of the chamber. Additionally, the chamber may include an impediment retainage device that prevents the objects caught in the chamber from re-entering the piping system when the vacuum source is turned off. Further, the chamber may include at least one chamber ingress device to allow the user to remove the captured objects from the chamber.

In an additional embodiment the pipe cleaning vacuum sealing apparatus may include an extra-piping system sealing boot. The present embodiment is generally used when cleaning gravity drainage piping systems by placing the sealing boot around a floor drain or floor cleanout. The sealing boot includes a proximal sealing edge that is pliable and will contort to form a substantially airtight seal with the adjacent flooring. The sealing boot may be formed with a distal vacuum source receiver wherein the receiver releasably and slideably receives the vacuum source and maintains a substantially airtight seal between the sealing boot and the vacuum source. Additionally the sealing boot may house a separation and retainage device. The purpose of the separation and retainage device is to capture and retain objects that are removed from the piping system. The separation and retainage device protects the vacuum source from damage that may be caused by objects leaving the piping system and entering the vacuum source. The separation and retainage device may include an impediment impingement device to deflect objects toward the perimeter of the sealing boot. Additionally, the sealing boot may include an impediment retainage device that prevents the objects caught in the sealing boot from re-entering the piping system when the vacuum source is turned off.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures:

Also, in the various figures and drawings, the following reference symbols and letters are used to identify the various elements described herein below in connection with the several figures and illustrations: DB, P, PI, and SW.

DESCRIPTION OF THE INVENTION

The pipe cleaning vacuum sealing apparatus of the instant invention enables a significant advance in the state of the art of pipe cleaning tools. The preferred embodiments of the pipe cleaning vacuum sealing apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
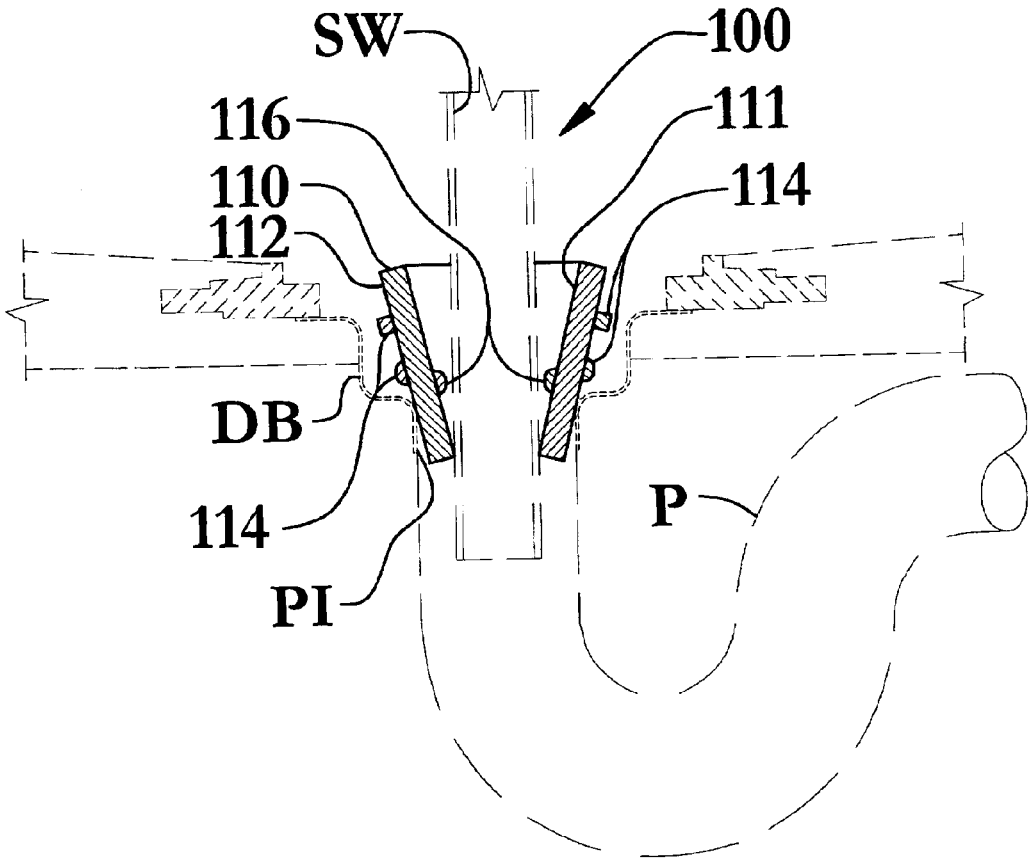
FIG. 1 is a detailed sectional view, in reduced scale, of a pipe cleaning vacuum sealing apparatus in use in a gravity drainage piping system with a suction wand.

With reference now to the accompanying figures and specifically to FIG. 1, in one of the many preferable configurations, the pipe cleaning vacuum sealing apparatus 100 incorporates, among other elements, an intra piping system sealing frustum 110. The sealing frustum 110 is generally shaped as a frustum of a circular cone. The sealing frustum 110 has an exterior surface 112 and an interior surface 111 with both surfaces being generally parallel. Alternatively, the exterior surface may be oriented at a greater angle from the vertical than the interior surface, such that the sealing frustum exhibits a greater thickness between the interior and exterior surface at the more distal aspects of the sealing frustum. The exterior surface 112 is releasably received by the piping system, hereafter labeled as P in the accompanying figures. Release from, and sealing to, the piping system P is facilitated by fabricating the exterior surface of the frustum of a resilient material, such as, for the purpose of illustration and not limitation, any of those in the general categories of elastomers and plastics. Alternatively, the entire frustum may be fabricated of such resilient material. The interior surface 111 releasably and slideably receives the vacuum source. Typically, the exterior surface 112 is compressed against either the drain body DB or the pipe inlet PI thus forming a substantially airtight seal. Similarly the vacuum source often terminates with a suction wand SW, often a 2" diameter section of pipe approximately 24"–48" in length, that is forced through the center of the sealing frustum 110 forming a substantially airtight seal between the interior surface 111 and the suction wand SW. The suction wand SW may then be forced into the piping system P and retracted from the piping system P while maintaining the substantially airtight interface between the sealing frustum 110 and the drain body DB or pipe inlet PI, as well as the interface between the suction wand SW and the interior surface 111.

The sealing frustum's 110 shape being generally similar to that of a frustum of a circular cone allows great flexibility in maintaining substantially airtight seals with the wide variety of drain bodies DB, pipe inlets PI, and vacuum sources. For large drain bodies DB and pipe inlets PI the sealing frustum 110 may be forced deeply into the body DB or inlet PI to obtain the desired seal, whereas for smaller openings the sealing frustum 110 may need only rest in the body DB or inlet PI to obtain a substantially airtight seal. Similarly, since the interior surface 111 is generally parallel to the exterior surface 112, or alternatively, formed with the exterior surface oriented at a greater angle from the vertical than the interior surface, such that the sealing frustum exhibits a greater thickness between the interior and exterior surface at the more distal aspects of the sealing frustum, it may be used with a wide variety of vacuum sources and sizes. For example, a single pipe cleaning vacuum sealing apparatus 100 may easily accommodate pipe inlet diameters, or drain body diameters, of varying sizes. Similarly, a single pipe cleaning vacuum sealing apparatus 100 may easily accommodate vacuum sources ranging in varying diameters. Additionally, multiple variations and sizes of pipe cleaning vacuum sealing apparatus 100 of similar configurations to those described herein will be obvious to one skilled in the art for use with piping systems of smaller diameters, such as domestic water systems, as well as piping systems of larger diameters such as storm sewer systems and cooling tower piping systems. Further, while the preceding examples refer to round drain bodies DB, pipe inlets PI, and vacuum sources, the pipe cleaning vacuum sealing apparatus 100 may be configured to accommodate all non-circular shapes.

Referring still to FIG. 1, numerous embodiments incorporate various annular engaging rings, both in the exterior surface 112 and the interior surface 111. For instance, the exterior surface 112 of the sealing frustum 110 may include any number of annular piping system engaging rings 114. Such piping system engaging rings 114 are compressed as the exterior surface 112 is compressed against the drain body DB or the pipe inlet PI, thus improving the seal between the surfaces and accommodating irregularities in the surfaces. Similarly, annular vacuum source engaging rings 116 may be formed on the interior surface 111 to improve the seal between the interior surface 111 and the vacuum source. The piping system engaging rings 114 and the vacuum source engaging rings 116 may be formed in any number of cross-sectional geometries. For example, the piping system engaging rings 114 and the vacuum source engaging rings 116 may be formed with generally semi-circular cross-sections or generally rectangular cross-sections. Additionally, the exterior surface of the sealing frustum 110 may include indicia to indicate the appropriate depth of insertion into pipe inlets PI based upon the diameter of the pipe inlet PI and the amount of vacuum applied.

Figure 2:
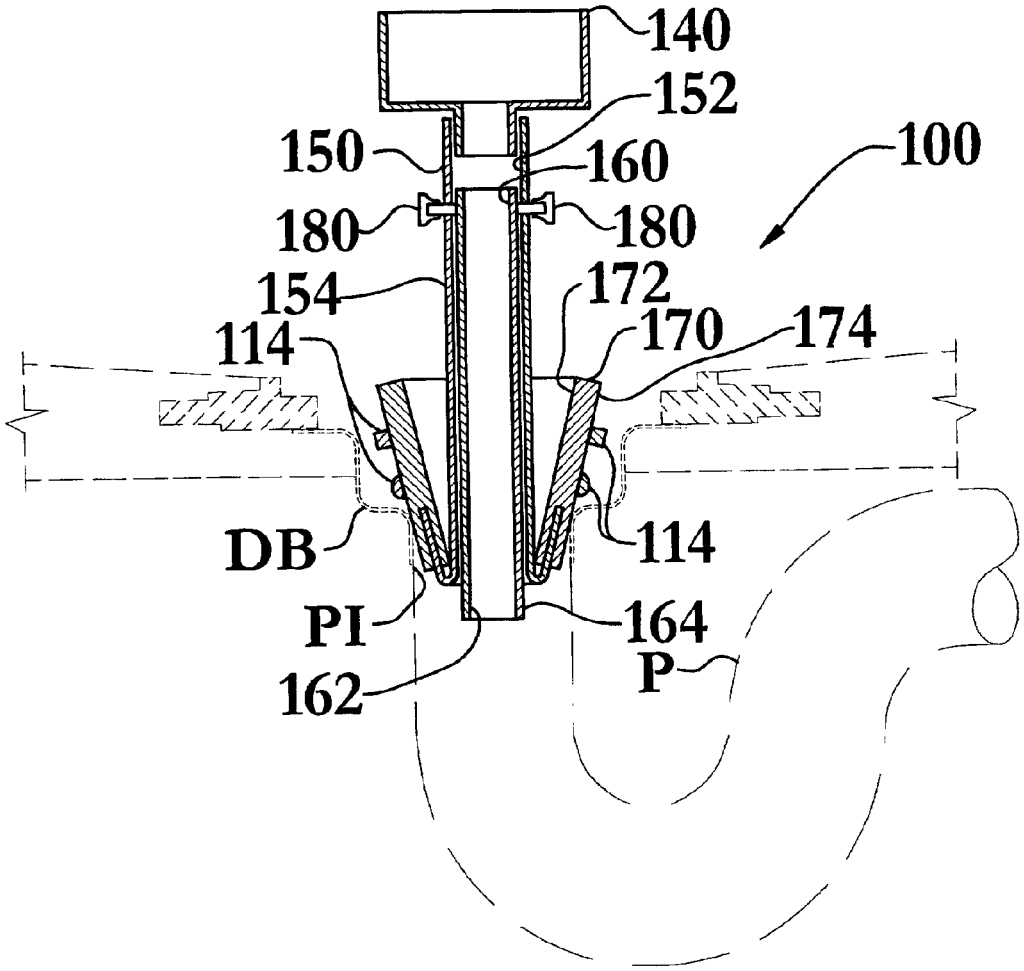
FIG. 2 is a detailed sectional view, in reduced scale, of a variation of the pipe cleaning vacuum sealing apparatus shown in FIG. 1 in use in a gravity drainage piping system with the telescoping suction tube in the retracted position.

Additional embodiments of the present invention may include a stationary suction tube 150 having a vacuum hose coupling 140 at the distal end and a suction tube sealer 170 at the proximal end, as shown in FIG. 2. The suction tube sealer 170 is similar to the sealing frustum 110 of the previous embodiment except that in this embodiment it is attached to a stationary suction tube 150 rather than facilitating an external vacuum source device such as a suction wand SW to pass through it. The suction tube sealer 170 has both an inner surface 172 and an outer surface 174. The outer surface 174 is adapted to be releasably received by the piping system and may include at least one piping system engaging ring 114 as previously described.

The vacuum hose coupling 140 is adapted to releasably receive the vacuum source. The vacuum hose coupling 140 may include any one of the many available coupling devices such as, for example but not limitation, boss couplers, universal couplers, cam lock shank couplers, combination nipple couplers, and cam and groove quick couplers. Additionally, the coupler 140 may include any number of hose fittings that reduce the likelihood of crimping the vacuum hose. For example, the coupler 140 may include a forty-five degree long sweep elbow type fitting so that the vacuum hose would not need to be bent into a sharp ninety degree turn to fluidly join the generally orthogonal stationary suction tube 150. Further, the coupler 140 may include a shut-off valve to turn on and turn off the vacuum as well as throttle the amount of vacuum. The stationary suction tube 150 of the present embodiment has an interior surface 152, an exterior surface 154, a stationary suction tube proximal end, and a stationary suction tube distal end.

Figure 3:
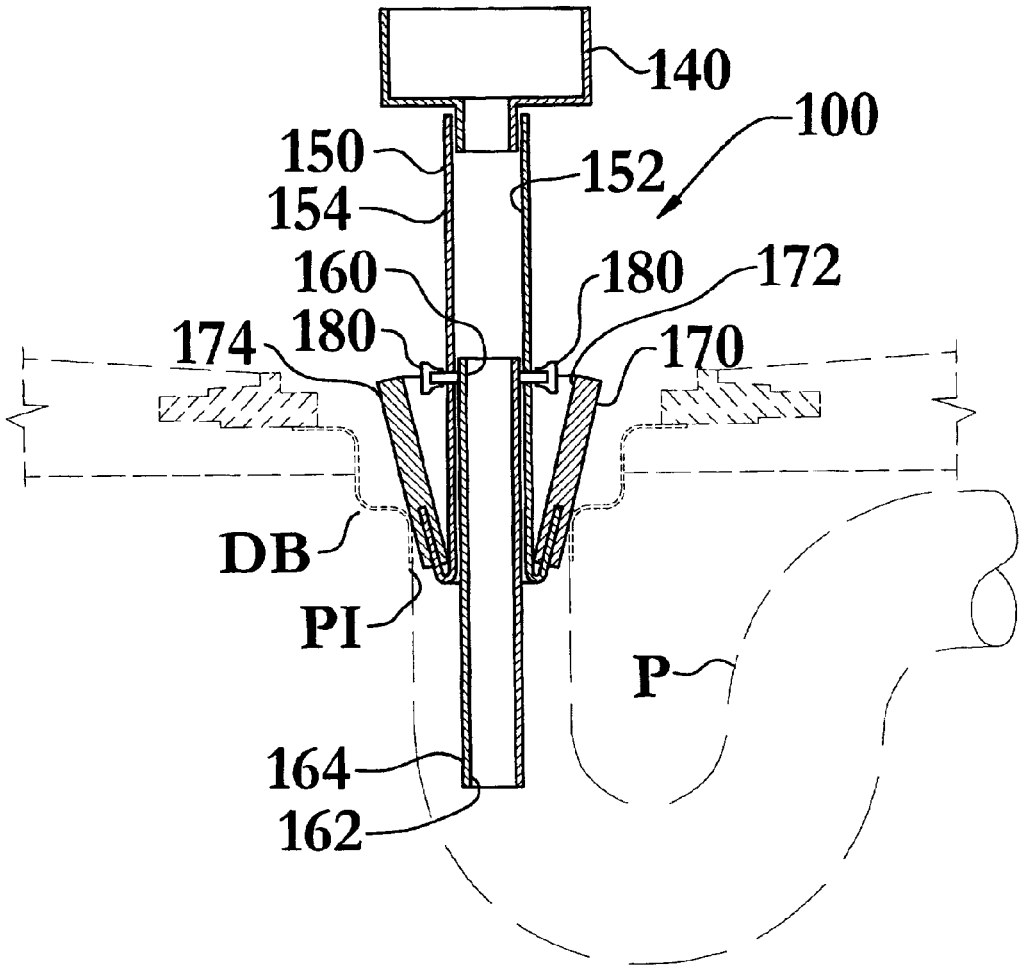
FIG. 3 is a detailed sectional view, in reduced scale, of the pipe cleaning vacuum sealing apparatus shown in FIG. 2 with the telescoping suction tube extended into the piping system.
Figure 4:
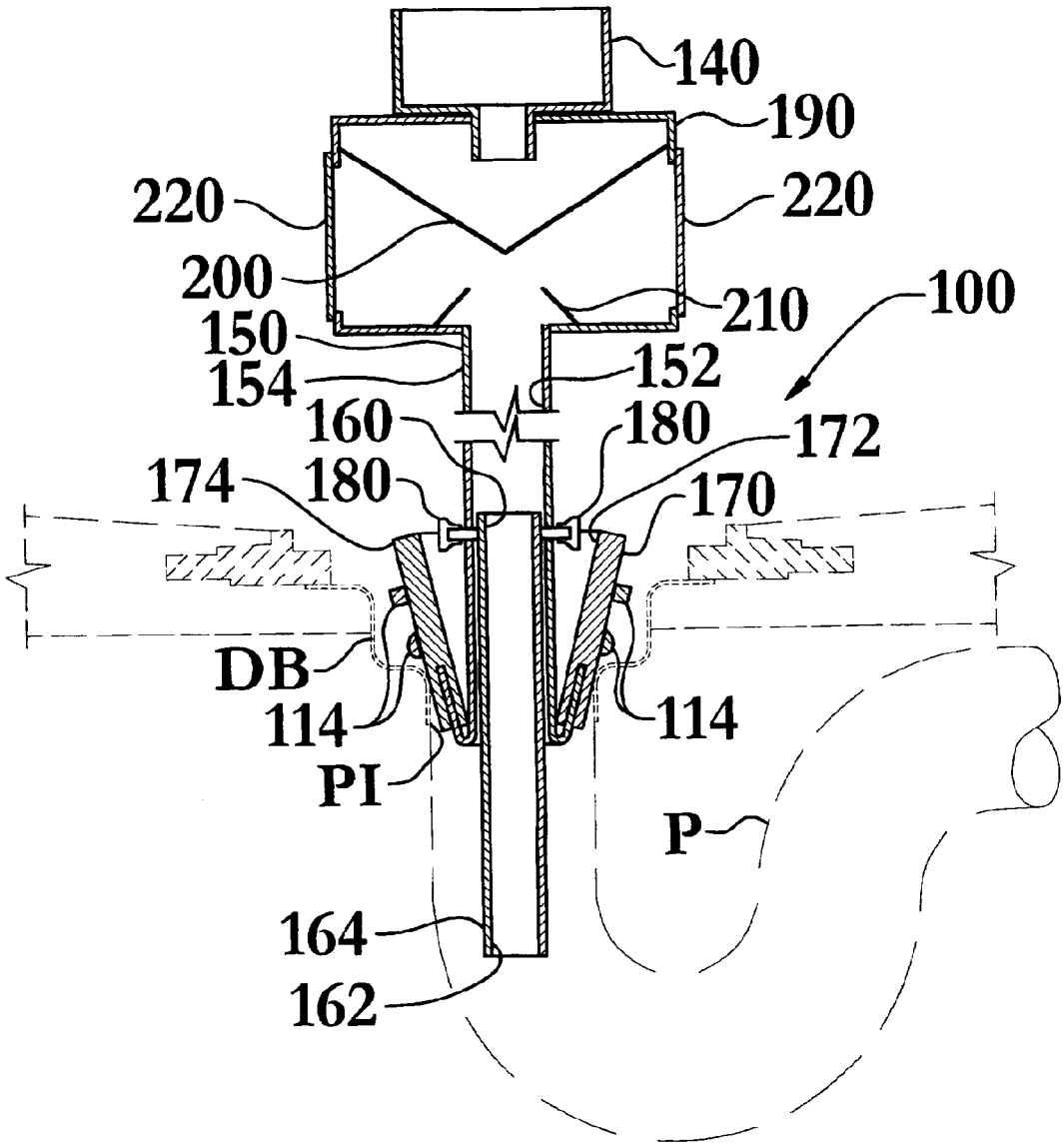
FIG. 4 is a detailed sectional view, in reduced scale, of a variation of the pipe cleaning vacuum sealing apparatus shown in FIG. 2 including a separation and retainage chamber.

As shown in FIG. 2, FIG. 3, and FIG. 4, a further variation includes a telescoping suction tube 160 having an interior surface 162 and an exterior surface 164. The telescoping suction tube 160 is slideably received within the stationary suction tube 150. When the exterior surface 164 of the telescoping suction tube 160 and the interior surface 152 of the stationary suction tube 150 are similar in size, a slideable friction fit between the stationary suction tube interior surface 152 and the telescoping suction tube exterior surface 164 is created. The present embodiment allows the user to extend the telescoping suction tube 160 into the piping system, as shown in FIG. 3.

Additionally, the present embodiment may include a telescopic retainer 180 adapted to releasably secure the telescoping suction tube 160 to the stationary suction tube 150. This allows the telescoping suction tube 160 to be secured in the extended position, shown in FIG. 3, or the non-extended position, shown in FIG. 2. Any number of commonly available retainers may be used for the telescopic retainer 180 and they additionally define a telescoping suction tube range of motion. The telescopic retainer 180 shown in FIG. 2., FIG. 3, and FIG. 4 consists of a simple thumb-screw assembly. The thumb-screw assembly consists of an engagement member secured to the telescoping suction tube 160 that slides in a slot formed in the stationary suction tube 150. A thumb-screw may then be screwed onto the engagement member and tightened against the stationary suction tube 150 securing the telescoping suction tube 160 in place. In the preferred embodiment, two such telescopic retainers 180 are spaced 180 degrees apart on the stationary suction tube 150.

Any of the preceding embodiments may include a separation and retainage chamber 190, as shown in FIG. 4. The separation and retainage chamber 190 is generally connected to the vacuum hose coupling 140 at a chamber distal end and fluidly connected to the stationary suction tube 150 at a chamber proximal end. The purpose of the separation and retainage chamber 190 is to capture and retain objects that are removed from the piping system. The chamber 190 protects the vacuum source from damage that may be caused by objects leaving the piping system and entering the vacuum source. The chamber 190 may include an impediment impingement device 200 to deflect objects toward the perimeter of the chamber. Additionally, the chamber 190 may include an impediment retainage device 210 that prevents the objects caught in the chamber 190 from re-entering the piping system when the vacuum source is turned off. The impediment impingement device 200 and the impediment retainage device 210 are preferably constructed of a heavy gauge screen material or expanded metal. Further, the chamber 190 may include at least one chamber ingress device 220 to allow the to user remove the captured objects from the chamber 190.

Figure 5:
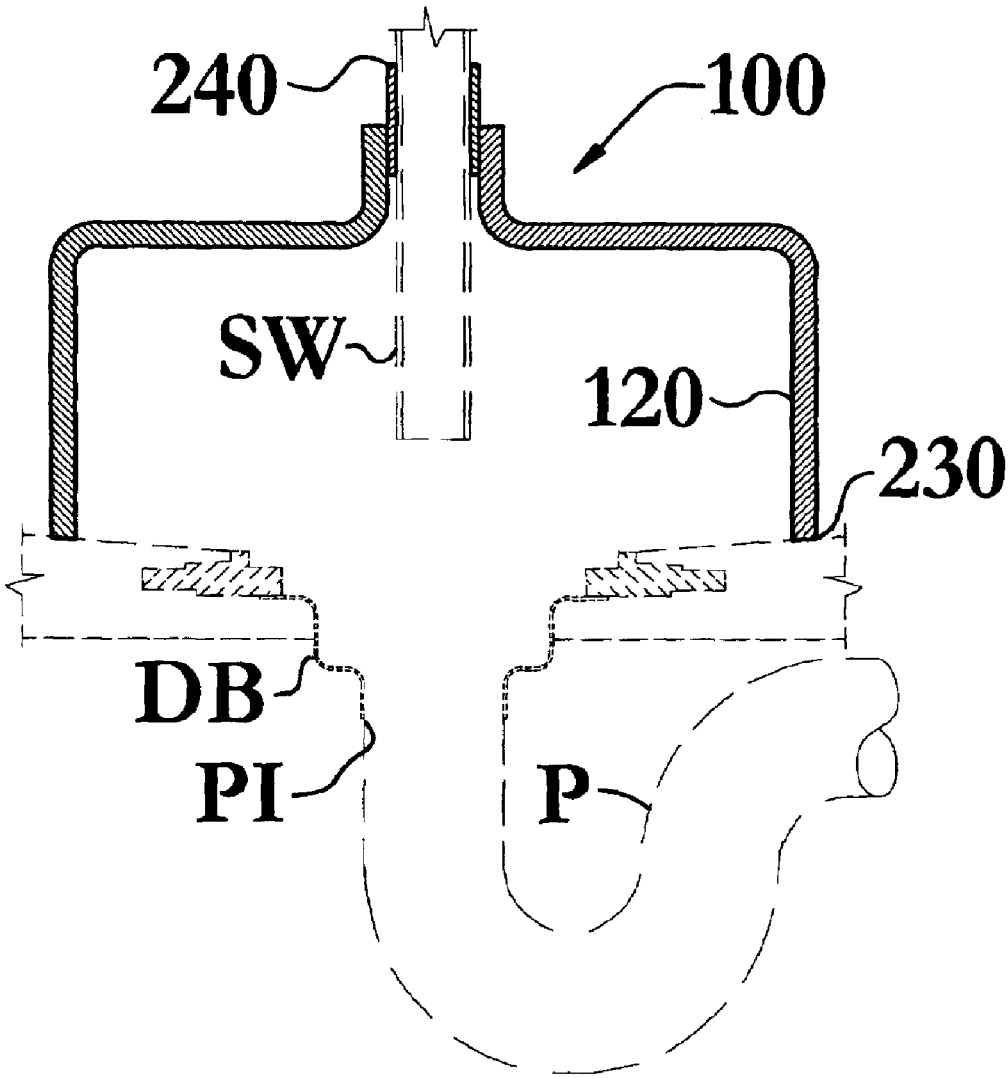
FIG. 5 is a detailed sectional view, in reduced scale, of a variation of a pipe cleaning vacuum sealing apparatus.
Figure 6:
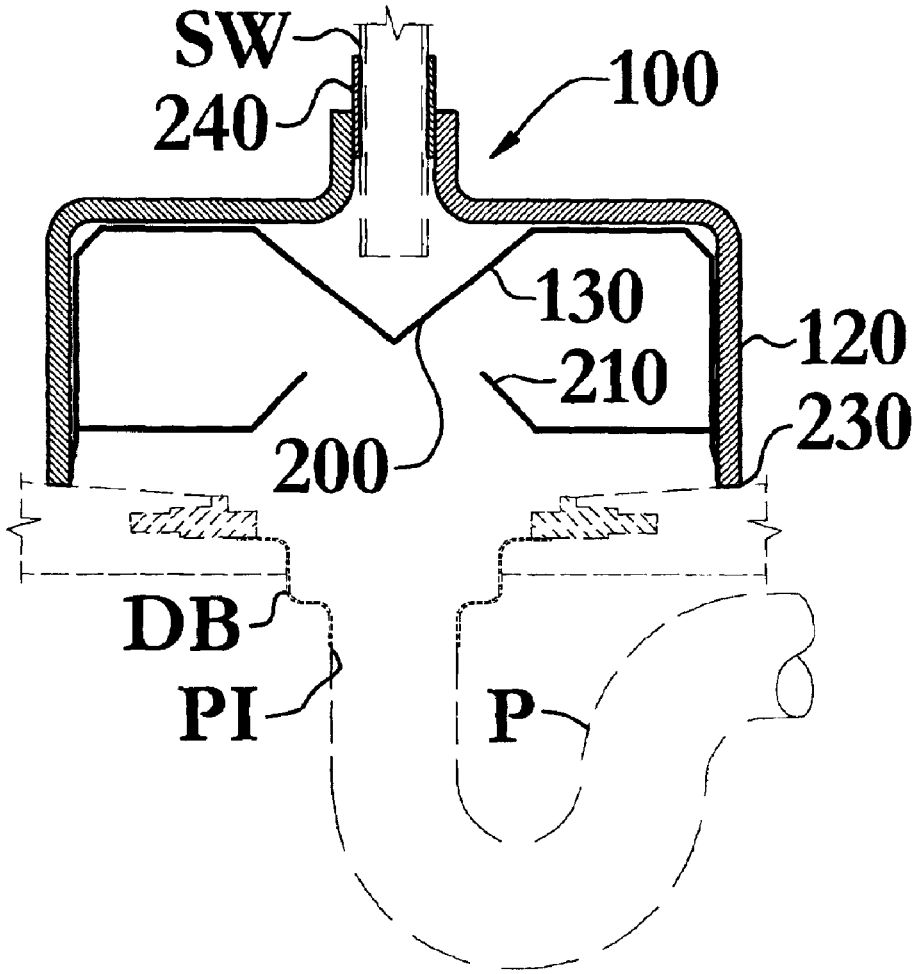
FIG. 6 is a detailed sectional view, in reduced scale, of a variation of the pipe cleaning vacuum sealing apparatus shown in FIG. 1.

Now referring to FIG. 5, in an additional embodiment, the pipe cleaning vacuum sealing apparatus 100 may include an extra-piping system sealing boot 120. The present embodiment is generally used when cleaning gravity drainage piping systems by placing the sealing boot 120 around a floor drain or floor cleanout. The sealing boot 120 includes a proximal sealing edge 230 that is pliable and will contort to form a substantially airtight seal with the adjacent flooring. The sealing boot 120 may be formed with a distal vacuum source receiver 240 wherein the receiver releasably and slideably receives the vacuum source and maintains a substantially airtight seal between the sealing boot 120 and the vacuum source. Additionally the sealing boot 120 may house a separation and retainage device 130, as shown in FIG. 6. The purpose of the separation and retainage device 130 is to capture and retain objects that are removed from the piping system. The separation and retainage device 130 protects the vacuum source from damage that may be caused by objects leaving the piping system and entering the vacuum source. The separation and retainage device 130 may include an impediment impingement device 200 to deflect objects toward the perimeter of the sealing boot 120. Additionally, the sealing boot 120 may include impediment retainage device 210 that prevents the objects caught in the sealing boot 120 from re-entering the piping system when the vacuum source is turned off.

The material and construction of the components of the pipe cleaning sealing apparatus 100 is selected to have the exterior surface 112 of the intra-piping embodiment, or the sealing edge 220 of the extra-piping embodiment, fabricated of a resilient material, such as, for the purpose of illustration and not limitation, any of those in the general categories of elastomers and plastics. Alternatively, the entire frustum may be fabricated of such resilient material. The material of the pipe cleaning vacuum sealing apparatus is further selected to be fabricated of an impact resistant and durable material that resists abrasion wear and that can withstand exposure to deleterious fluids and substances, such as, without limitation, biological, and industrial fluids and substances. Some such exemplary substances and fluids include steam, high temperature water, cleaning fluids, petrochemicals, biological fluids, oil, grease, bacteria, fungi, insects, pests, and raw and prepared agricultural food stuffs, to name a few.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations for compatibility with the pipe cleaning vacuum sealing apparatus. Accordingly, even though only few variations of the present invention are described herein, it is to be understood that the practice of such additional modifications and variations and the equivalents thereof, are within the spirit and scope of the invention as defined in the following claims.

The corresponding structures, materials, acts, and equivalents of all means or step plus function elements in the claims below are intended to include any structure, material, or acts for performing the functions in combination with other claimed elements as specifically claimed.

I claim:

1. A pipe cleaning vacuum sealing apparatus adapted for fluidly connecting a piping system and a vacuum source, comprising:

an intra piping system sealing frustum having an exterior surface to be releasably received by the piping system and having an interior surface to releasably and slideably receive the vacuum source such that the vacuum source may slide through the sealing frustrum to extend into and retract from the piping system while maintaining a substantially airtight seal between both the vacuum source and the sealing frustrum and the sealing frustrum and the piping system, wherein the exterior surface is formed with at least one annular piping system engaging ring designed to assist in the creation and maintenance of a substantially airtight seal between the sealing frustum and the piping system via compression of the annular piping system engaging ring there between.

2. The apparatus according to claim 1, wherein the at least one annular piping system engaging ring is formed with a generally semi-circular cross-section.

3. The apparatus according to claim 1, wherein the at least one annular piping system engaging ring is formed with a generally rectangular cross-section.

4. A pipe cleaning vacuum sealing apparatus adapted for fluidly connecting a piping system and a vacuum source, comprising;

an intra piping system sealing frustum having an exterior surface to be releasably received by the piping system and having an interior surface to releasably and slideably receive the vacuum source such that the vacuum source may slide through the sealing frustrum to extend into and retract from the piping system while maintaining a substantially airtight seal between both the vacuum source and the sealing frustum and the sealing frustrum and the piping system, wherein the interior surface is formed with at least one annular vacuum source ingaging ring.

5. A pipe cleaning vacuum sealing apparatus adapted for fluidly connecting a piping system and a vacuum source, comprising a suction tube sealer having a sealer inner surface and a sealer outer surface and adapted to be releasably received by the piping system;

a vacuum hose coupling adapted to releasably receive the vacuum source;

a stationary suction tube having an interior surface, an exterior surface, a stationary suction tube proximal end, and a stationary suction tube distal end, fluidly connected to the suction tube sealer at the stationary suction tube proximal end fluidly connected to the vacuum hose coupling at the stationary suction tube distal end;

a telescoping suction tube having an interior surface and an exterior surface wherein the telescoping suction tube is slideably received by the stationary suction tube creating a slideable friction fit between the stationary suction tube interior surface and the telescoping suction tube exterior surface; and a telescopic retainer adapted to releasably secure the telescoping suction tube to the stationary suction tube and define a telescoping suction tube range of motion.

6. The apparatus according to claim 5, wherein the sealer outer surface is formed with at least one annular piping system engaging ring.

7. The apparatus according to claim 5, wherein the a least one annular piping system engaging ring is formed with a generally semi-circular cross section.

8. The apparatus according to claim 5, wherein the least one annular piping system engaging ring is formed with a generally rectangular cross-section.

9. A pipe cleaning vacuum sealing apparatus adapted for fluidly connecting a piping system and a vacuum source, comprising:

a suction tube sealer having a sealer inner surface and a sealer outer surface and adapted to be releasably received by the piping system;

a vacuum hose coupling adapted to releasably receive the vacuum source;

a separation and retainage chamber connected to the vacuum hose coupling at a chamber distal end and fluidly connected to the stationary suction tube at a chamber proximal end;

a stationary suction tube having an interior surface, an exterior surface, a stationary suction tube proximal end and a stationary suction tube distal end, connected to the suction tube sealer at the stationary suction tube proximal end and connected to the separation retainage chamber at the stationary suction tube distal end;

a telescoping suction tube having an interior surface and an exterior surface wherein the telescoping suction tube is slideably received by the stationary suction tube creating a slideable friction fit between the stationary suction tube interior surface and the telescoping suction tube exterior surface; and a telescopic retainer adapted to releasably secure the telescoping suction tube to the stationary suction tube and define a telescoping suction tube range of motion.

10. The apparatus according to claim 9, wherein the separation and retainage chamber further includes an impediment impingement device and an impediment retainage device.

11. The apparatus according to claim 9, wherein the separation and retainage chamber further includes at least one chamber ingress device.

12. The apparatus according to claim 9, wherein the sealer outer surface is formed with at least one annular piping system engaging ring.

13. The apparatus according to claim 12, wherein the at least one annular piping system engaging ring is formed with a generally semi-circular cross-section.

14. The apparatus according to claim 12, wherein the at least one annular piping system engaging ring is formed with a generally rectangular cross-section.

15. A pipe cleaning vacuum sealing apparatus adapted for fluidly connecting a piping system, including a drain body, and a vacuum source wherein the apparatus is located external to the piping system, comprising:

an extra-piping system sealing boot having a proximal sealing edge and formed with a distal vacuum source receiver wherein the receiver releasably and slideably receives the vacuum source and creates a substantially airtight seal between the distal vacuum source receiver and the vacuum source and the proximal sealing edge is configured to produce a substantially airtight seal around the drain body; and a separation and retainage device located within the sealing boot and configured to capture and retain particulate as it is drawn through the sealing boot so as to prevent the particulate from reaching the vacuum source.

* * * * *

UNITED STATES PATENT AND TRADEMARK OFFICE

CERTIFICATE OF CORRECTION

PATENT NO. : 6,941,613 B2
DATED : September 13, 2005
INVENTOR(S) : David D. Bryant It is certified that error appears in the above-identified patent and that said Letters Patent is hereby corrected as shown below:

Title page,
Item [74], *Attorney, Agent, or Firm*, reads "Gallagher & Dewey Co., LPA; Daniel J. Dewey; Michael J. Gallagher" should read -- Gallagher & Dawsey Co., LPA; David J. Dawsey; Michael J. Gallagher --.

Signed and Sealed this

First Day of November, 2005

JON W. DUDAS
*Director of the United States Patent and Trademark Office*